US005288076A

United States Patent [19]

Jackson et al.

[11] Patent Number: 5,288,076

[45] Date of Patent: Feb. 22, 1994

[54] GAME OF PRESIDENTS AND THE ELECTORAL COLLEGE VOTING SYSTEM

[75] Inventors: Jerry F. Jackson, Murfreesboro, N.C.; Bert N. Adams, Madison, Wis.; Roald H. Sorensen, Raleigh, N.C.

[73] Assignee: The Presidents Group, Murfreesboro, N.C.

[21] Appl. No.: 53,433

[22] Filed: Apr. 28, 1993

[51] Int. Cl.[5] ..... A63F 3/00

[52] U.S. Cl. ..... 273/279

[58] Field of Search ..... 273/251, 252, 254, 257, 273/279

[56] References Cited

U.S. PATENT DOCUMENTS

| | | | |
|---|---|---|---|
| 753,949 | 3/1904 | Wing | 273/279 |
| 1,616,216 | 2/1927 | Dempsey | 273/279 |
| 3,368,816 | 2/1968 | Milazzo et al. | 273/257 |
| 4,085,938 | 4/1978 | Bean, Jr. | 273/279 |
| 4,092,028 | 5/1978 | Marse | 273/257 X |
| 4,643,429 | 2/1987 | Crandon et al. | 273/257 X |

FOREIGN PATENT DOCUMENTS

| | | | |
|---|---|---|---|
| 2493164 | 5/1982 | France | 273/257 |

*Primary Examiner*—William Stoll

*Attorney, Agent, or Firm*—Rhodes, Coats & Bennett

[57] ABSTRACT

The present invention entails a game and game board apparatus. The game board apparatus includes a map of the United States with each individual state comprising a puzzle piece and wherein there is inscribed on the game board apparatus the number of electoral college votes controlled by each respective state. In addition, the game apparatus includes a series of state playing cards with each state playing card identifying a state, the number of electoral college votes of that state, a list of presidents produced by that state and other state information. The object of the game is to accumulate the most electoral college votes. In order to collect electoral votes the basic thrust of the game entails accumulating a selected number of contiguous or so-called isolated states and once such has been accumulated then the electoral college votes of those contiguous states or isolated state or states are acquired by the player who has accumulated the contiguous states.

2 Claims, 3 Drawing Sheets

GAME OF PRESIDENTS AND THE ELECTORAL COLLEGE VOTING SYSTEM

FIELD OF INVENTION

The present invention relates to games and game board apparatuses and more particularly to a president's game that is based on the electoral college voting system.

BACKGROUND OF THE INVENTION

Game and game boards involving Presidents of the United States have long been popular. For example, see the disclosures found in the following U.S. Pat. Nos.: 4,709,926; 4,865,327; 357,184; 3,068,010; 1,292,180; 1,115,431; 4,643,426; 4,085,938; and 4,092,028.

While many of these president's games are in fact educational, they have not for the most part, been interesting, consuming and exciting to play. Moreover, many of the president's games of the prior art have not really incorporated a realistic approach to the presidential election process.

Thus, there is a need for a presidential game that is both educational and exciting to play while at the same time entails a realistic approach to the presidential election process.

SUMMARY AND OBJECTS OF THE INVENTION

The present invention entails a presidential game that revolves around the electoral college and which can be played by 2 or more players. In particular, the game and game board apparatus includes a map of the United States with the map being comprised of state puzzle pieces and wherein the map includes an indication of the electoral votes of the respective states. In addition, the game and game board apparatus includes a deck of state cards with each card identifying a state, the electoral votes of that state, the presidents produced by that state and other data about that particular state.

The object of the game is to win the most electoral votes of the players playing the game at any one time. The basic thrust of the game revolves around each individual player attempting to gain access to a selected group of cards that represent contiguous states. Once a player has in his or her possession a group of four cards, for example, that represent four contiguous states, that player can discard (lay down) those cards and those electoral votes associated with those four contiguous states then belong to and are counted for that player.

It is therefore an object of the present invention to provide a game of presidents that is exciting and realistic as well as educational.

Another object of the present invention resides in a game and game board apparatus for playing a presidents game that is built on the electoral college system and consequently teaches young people and adults as well the cornerstone of our presidential electoral process.

Another object of the present invention is to provide a presidents game of the character referred to above that can be played and enjoyed by people of all ages.

Still a further object of the present invention resides in the provision of a presidents game of the character referred to above that rewards skill and strategy and which encourages concentration.

Another object of the presidents invention resides in the provision of a presidents game that is easy to play and can be played by two or more players.

Other objects and advantages of the present invention will become apparent and obvious from a study of the following description and the accompanying drawings which are merely illustrative of such invention.

DETAILED DESCRIPTION OF THE INVENTION

Figure 1:
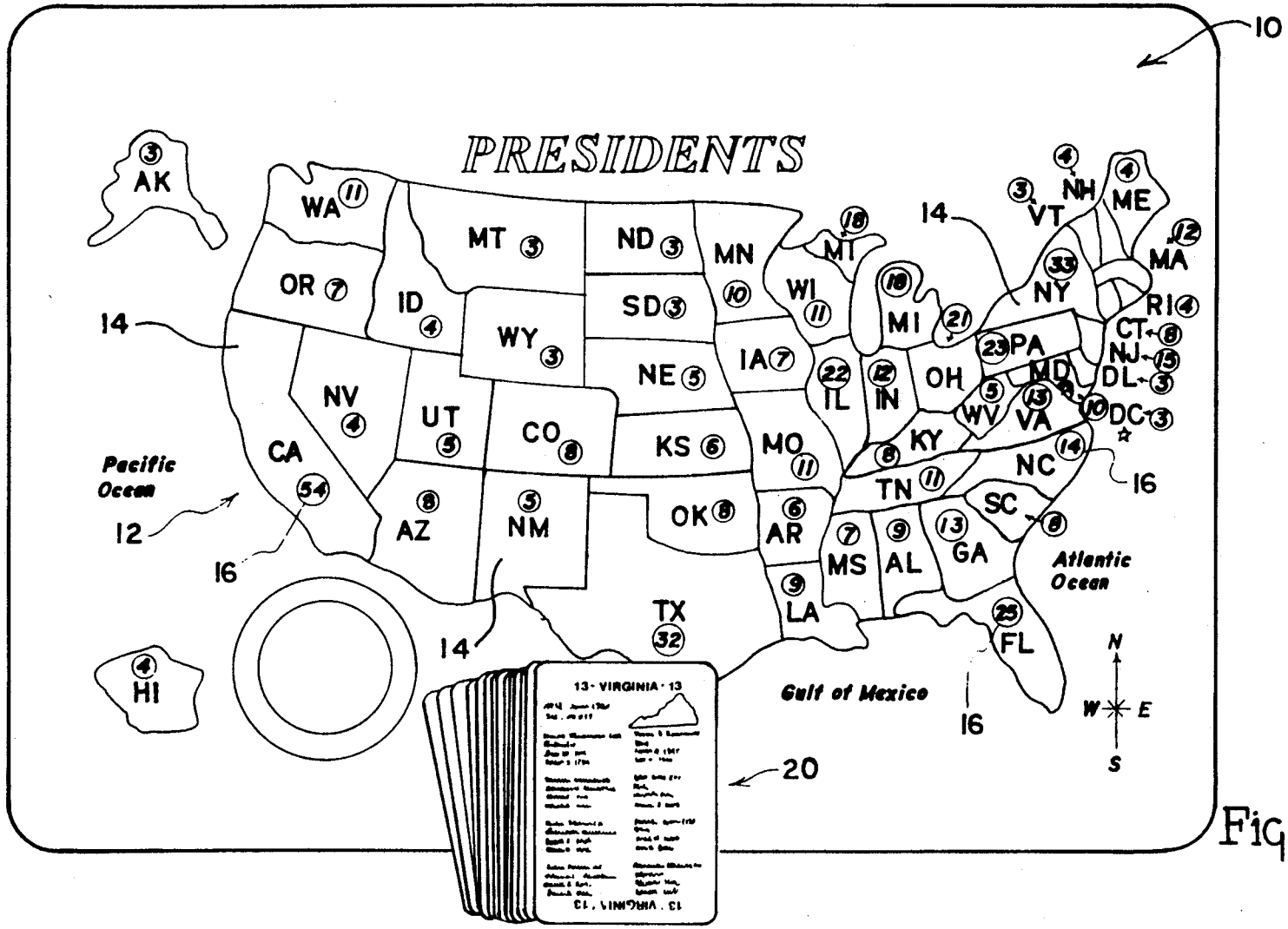
FIG. 1 is a plan view of the game board and game apparatus of the present invention.
Figure 2:
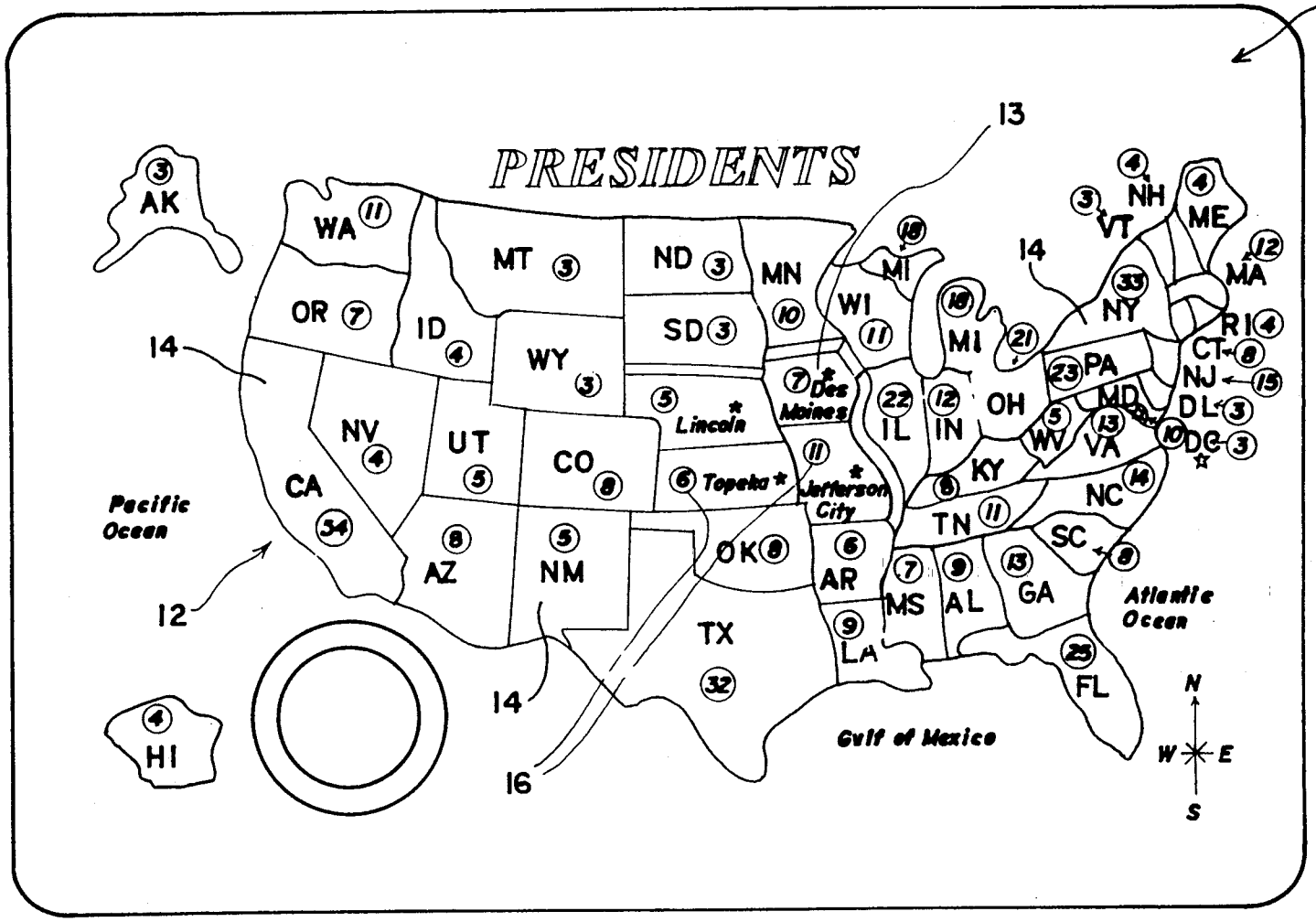
FIG. 2 is a plan view of the state puzzle map that forms a part of the game board with four contiguous states, Nebraska, Kansas, Indiana and Missouri being removed from the map structure.

With further reference to the drawings, the presidents game is shown therein and indicated generally by the numeral 10. The presidents game 10 basically comprises a game board apparatus and a deck of state cards. First, viewing the game board, the same includes a United States map indicated generally by the numeral 12. Forming a part of the United States map 12 is a base 13 and a plurality of individual state puzzle pieces 14 supported on the base. Each state is formed into a removable puzzle piece 14 and can be easily and conveniently removed from the game board and reinserted onto the game board. Formed on each puzzle piece 14 and the base 13 is indicia 16 indicating the number of electoral college votes of each particular state.

As noted above, also forming a part of the game and game board apparatus of the present invention is a deck of state cards indicated generally by the numeral 20. Each card represents a respective state and because the District of Columbia does indeed have electoral votes, there is a card provided for the District of Columbia.

Figure 3:
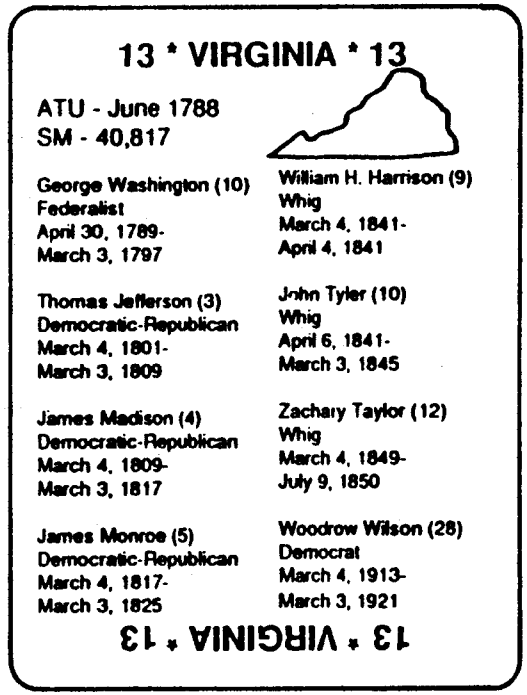
FIG. 3 shows two example state cards that form a part of the game apparatus of the present invention.
Figure 3:
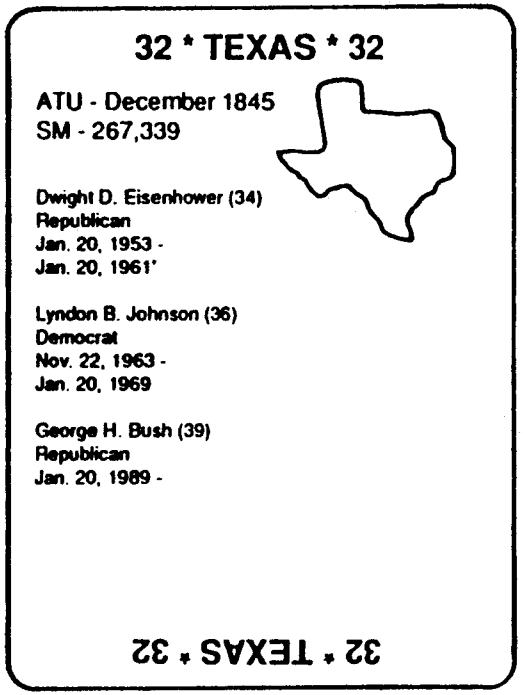

Each state card includes a map 21 of the state along with a number indicating the electoral votes (i.e. 32 for Texas and 13 for Virginia) of that state. See FIG. 3. In addition, and particularly for educational purposes, each card 20 includes a list of presidents produced by that state along with other information about that state such as when the state was admitted to the Union (ATU) and area of the state indicated in square miles (SM). In particular, the presidents set forth on the respective state cards were residents of that particular state when elected to the presidency.

The game of the present invention can be played by two, three, four or more players. The object of the game is to be elected president. The player receiving the highest number of electoral votes is elected the president. As will be appreciated from subsequent portions of this disclosure, the number of electoral votes a player receives depends in great part on the skill of that player.

Play is begun with all state cards 20 being turned face down. To determine the particular sequence of play, each player draws from the deck. The player drawing the state with the highest number of electoral votes is deemed the dealer and accordingly, will play last. The cards are then placed back in the deck and reshuffled. Each player is dealt four cards face down and the player to the dealer's left starts play. The remaining cards of the deck are placed face down and form the deck from which cards are drawn during the course of the game.

The principal object of the game is to acquire electoral votes by obtaining a series of state cards that identify contiguous states. The basic rule of the game requires that a player obtain four cards that identify four contiguous states. Once a player has obtained four such cards he or she can then discard the four cards and the electoral votes of those four contiguous states are credited to that player.

With that in mind, the first player requests from any other player a state that touches a particular state that the first player then holds. For example, a player may have been dealt North Carolina, Illinois, South Dakota and Arizona. That player would then ask one of the other players for a state that touches one of the four states. For a better understanding of the game and in the way of an example, a player holding the four states just described could propound any number of requests. For example, by holding the state of North Carolina, the player could ask for any one of the following states: Virginia, Tennessee, South Carolina or Georgia since all of these states touch the state of North Carolina. By holding the state of Illinois, the player could request from another player any one of the following states: Indiana, Missouri, Kentucky, Iowa or Wisconsin. By holding the state of South Dakota, the player could request any one of the following states: Minnesota, Iowa, North Dakota, Montana, Wyoming or Nebraska. By holding the state of Arizona, the player could request any one of the following states: Colorado, California, Nevada, Utah or New Mexico.

A player who is asked for a state card must surrender the card bearing the state if he or she is holding that card. If a player is successful with a request then that player continues to seek a card at a time from any player in the group. It is important to appreciate that a player cannot ask for a state that is not contiguous with a state that the player is at that time holding. As noted above, the player making the request is free to make the request to any player in the group and continues to make the request until the player receives a "no". Upon receiving a "no" reply, that player is then required to draw a card from the deck and the next player begins in the same manner as just described. Play then continues in this manner until all of the states are "won".

Each player is entitled to "one pass". If used, it is usually late in the course of a game.

As noted above, electoral votes are won or gained by acquiring four contiguous states. For example, if one acquires the states of Utah, Colorado, Nebraska and South Dakota, all of these states are contiguous and consequently these cards can be discarded and the electoral votes associated with these states are credited to the player who gained and discarded the corresponding four state cards.

It should be noted that all four states do not have to touch each other. The requirement is that the four states must be connected in some way.

The appropriate time for discarding a group of four contiguous states would be after receiving a "no" response and making a draw from the deck. This gives a player the opportunity to maximize the electoral votes that the player may have acquired.

Again, the rules require that the group consist of only four states, not five or more.

It is also important in providing the orderly flow of the game for the individual state puzzle pieces 14 to be removed from the game board at the same time the group of state cards are discarded or layed down. This allows all the players to clearly see the remaining states that are left to be won.

The basic rule of the game is that electoral votes are won by winning four contiguous states. But it should be appreciated that in the process of playing the game there will be groups of states or even individual states that become totally isolated. For example, there will be times when there will only be three states that are contiguous and then other times when there will only be two states that will be contiguous. Finally, there will be certain situations when a single state will be isolated. In all of these cases, electoral votes can be won by simply acquiring the state card for the single state that is isolated or acquiring all of the cards of the contiguous isolated states. It is appreciated that at the beginning of the game two states, Hawaii and Alaska, are both isolated and can be laid down and credited to the player having the same from the outset.

The game continues by the players making their requests to the other players. It is appreciated that after making a request and receiving a "no" response that the player making the request will draw from the deck. The deck of cards will be depleted before the game concludes and then players will continue making their requests. After all the cards have been played, each player will count the number of electoral votes shown on their cards. The player with the greatest number of electoral votes is declared president and accordingly the winner.

The game is provided with penalties. For example, if a player requests a state for which the player is not holding a contiguous state then that player looses the next turn. If a player asks for a state that the player actually holds, then that player looses his or her next turn. Any player may challenge another player about a request if the challenging player believes that the ask was illegal. If the challenger is correct the asking player looses the next turn. If the challenger is incorrect, the challenger looses his or her next turn.

The above basically describes a set of rules for the game of the present invention but it is appreciated that the rules can be varied without departing from the basic spirit of the invention. It is appreciated that the game of the present invention can be an exciting and contagious game that rewards skill and clever strategy. But beyond being an exciting and fun game, the presidents game of the present invention is educational and is particularly designed to be suitable for players of all ages.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of playing an electoral college game comprising the steps of:

a) dealing the required selected number of state cards from the deck of cards to each individual player of the game with each card identifying a state and the number of electoral college votes of that state;

b) each player seeking to put together the necessary number of contiguous state cards by asking other players for the state needed or by drawing the state card from the deck;

c) accumulating the required number of state cards that represent contiguous states and laying down the group of contiguous state cards from the player's hand;

d) removing the corresponding contiguous states from a state puzzle board including a group of individual state puzzle pieces, and wherein the state puzzle board includes indicia thereon that indicates the number of electoral college votes of each state; and e) continuing to draw state cards from other players and the deck and to accumulate contiguous state cards until a player has accumulated the required number of electoral college votes and is declared the winner of the presidency.

2. The method of claim 1 wherein certain states during the course of the game become isolated inasmuch as they are not contiguous with the number required by the general rules and wherein the method includes claiming the electoral college votes of these isolated states by acquiring the state card of that isolated state or states during the course of the game.

* * * * *